United States Patent [19]

Okamoto

[11] 4,335,639

[45] Jun. 22, 1982

[54] PREFERENTIAL CIRCUIT FOR ELECTRONIC MUSICAL INSTRUMENT

[75] Inventor: Eisaku Okamoto, Hamamatsu, Japan

[73] Assignee: Nippon Gakki Seizo Kabushiki Kaisha, Japan

[21] Appl. No.: 215,149

[22] Filed: Dec. 11, 1980

[30] Foreign Application Priority Data

Dec. 20, 1979 [JP] Japan ..... 54-165894

[51] Int. Cl.[3] ..... G10H 1/00

[52] U.S. Cl. ..... 84/1.01; 84/DIG. 2; 84/DIG. 20; 340/365 R

[58] Field of Search ..... 84/DIG. 2, 1.01, DIG. 20; 340/365 R, 365 C

[56] References Cited

U.S. PATENT DOCUMENTS 4,141,268 2/1979 Kugisawa ..... 84/DIG. 2
4,170,768 10/1979 Kitagawa ..... 84/DIG. 2
4,204,452 5/1980 Uchiyama ..... 84/DIG. 2
4,244,258 1/1981 Finch ..... 84/DIG. 2

*Primary Examiner*—Gene Z. Rubinson
*Assistant Examiner*—Forester W. Isen
*Attorney, Agent, or Firm*—Kane, Dalsimer, Kane, Sullivan and Kurucz

[57] ABSTRACT

A preferential circuit for an electronic musical instrument is provided in which a memory circuit is employed to memorize a key data signal corresponding to the last depressed key and at least one key data signal corresponding to the second last depressed key. To drive a tone generator, the memory circuit normally outputs the key data signal of the last depressed key but outputs the signal of the second last depressed key when the last depressed key is released with the second last depressed key being held depressed. If the player depresses an errouneous key and release this last depressed error key, a musical tone corresponding to the second last depressed key is then produced.

6 Claims, 4 Drawing Figures

(a) ø
(b) SYP
(c) DATA 1
(d) ⌜A⌟ Key
(e) KON
(f) DATA 2
(g) COM
(h) DEL
(i) COP
(j) COUT
(k) LAP
(l) DATA 3
(m) GON
(n) ⌜A⌟⌜G⌟ Key
(o) KON
(p) DATA 2
(q) COM
(r) DEL
(s) COP
(t) COUT
(u) LAP
(v) DATA 3
(w) GON
ON
OFF
Generation of musical tones
Cease of musical tones
(0,0)
(1,0)
(0,1)

PREFERENTIAL CIRCUIT FOR ELECTRONIC MUSICAL INSTRUMENT

BACKGROUND OF THE INVENTION

1. Field of the Invention

This invention relates generally to an electronic musical instrument and, more particularly, to a preferential circuit for use in an electronic musical instrument which is capable of producing in compliance with a predetermined priority order only a single musical tone corresponding to a certain key among keys which are held depressed simultaneously with each other.

2. Description of the Prior Art

An electronic musical instrument has generally an upper keyboard, lower keyboard and pedal keyboard used for producing melodious tones, chords and base tones respectively. These keyboards of a conventional type are arranged in such a manner that musical tones, which correspond to the respective keys of the keyboard held depressed simultaneously at a time, are produced together at the same time. The beginners for electronic musical instruments, however, commonly play melodious notes in sequence of independent musical notes, namely they play the notes one by one. Therefore, it is common for the known electronic musical instrument for beginners to have therein such a musical tone generating system for the upper keyboard as is implemented by employing a single tone configuration so as to simplify a circuit arrangement. The single tone configuration means that, when used in the musical tone generating system, only a single musical tone may be produced at a time which tone corresponds to a certain key among keys held depressed simultaneously with each other. In addition to the above, the electronic musical instrument manufactured exclusively for learning and teaching use may preferably be made by employing the single tone configuration in its musical tone generating system for an upper keyboard. Further in practice a musical tone generating system for a pedal keyboard has been generally implemented by using the single tone configuration.

For use in electronic musical instruments having the single tone configuration therein, there have been proposed a variety of circuit systems for a preferential circuit in which a musical tone corresponding to a certain key among keys held depressed simultaneously with each other is selectively determined in a predetermined priority order. One of the circuit systems is known as the high pitch preferential system in which a musical tone corresponding to a depressed key of a keyboard having a higher pitch is produced in preference to other tones of the keys being depressed. Another system is designated as the low pitch preferential system in which a musical tone corresponding to a key of a keyboard having a lower pitch is produced among the tones of the depressed keys. These two systems when applied to electronic musical instruments can make it possible to simplify circuit configuration on the one hand, and on the other hand, however, there is a disadvantage that the most appropriate musical note the player have in mind, which corresponds mostly to the newest depressed key, sometimes may fail to be produced at the time when the key is depressed. The other system is known as the last depression preferential system in which a musical tone corresponding to a key of a keyboard depressed last is produced in preference to the tones of other keys having been depressed. This system eliminates the disadvantages accompanying the above mentioned two circuit systems. The conventional last depression preferential system, however, has a disadvantage that, when a key is erroneously depressed after a correct key has been depressed, a relatively complicated operation is required to produce a correct musical tone by carrying out re-depression of the correct key after releasing it temporarily.

SUMMARY OF THE INVENTION

It is, therefore, a principal object of the present invention to provide a new and novel preferential circuit for use in electronic musical instruments, in which a musical tone corresponding to a key of a keyboard depressed last is produced in preference to tones of other keys having been depressed.

It is a further object of the invention to provide a preferential circuit which produces a musical tone corresponding to a key of keyboards having been previously depressed just prior to depression of the last depressed but now released key.

In brief, a preferential circuit for electronic musical instruments according to the invention is constructed such that a memory circuit stores in the same sequential order as that of key depressions key data signals corresponding to respective depressed keys of keyboards, and that the stored key data signals are read out in the reverse order to the key depressions. Thus, if a key is depressed erroneously after a correct key has been depressed, the preferential circuit according to the invention may function to produce a musical tone corresponding to a correct key simply by releasing the erroneously depressed key.

The foregoing and other objects, features and advantages of the invention will be apparent from the following, more detailed, description of a preferred embodiment taken in conjunction with the accompanying drawings, in which:

DETAILED DESCRIPTION

The invention will now be described in more detail in conjunction with the accompanying drawings.

Figure 1:
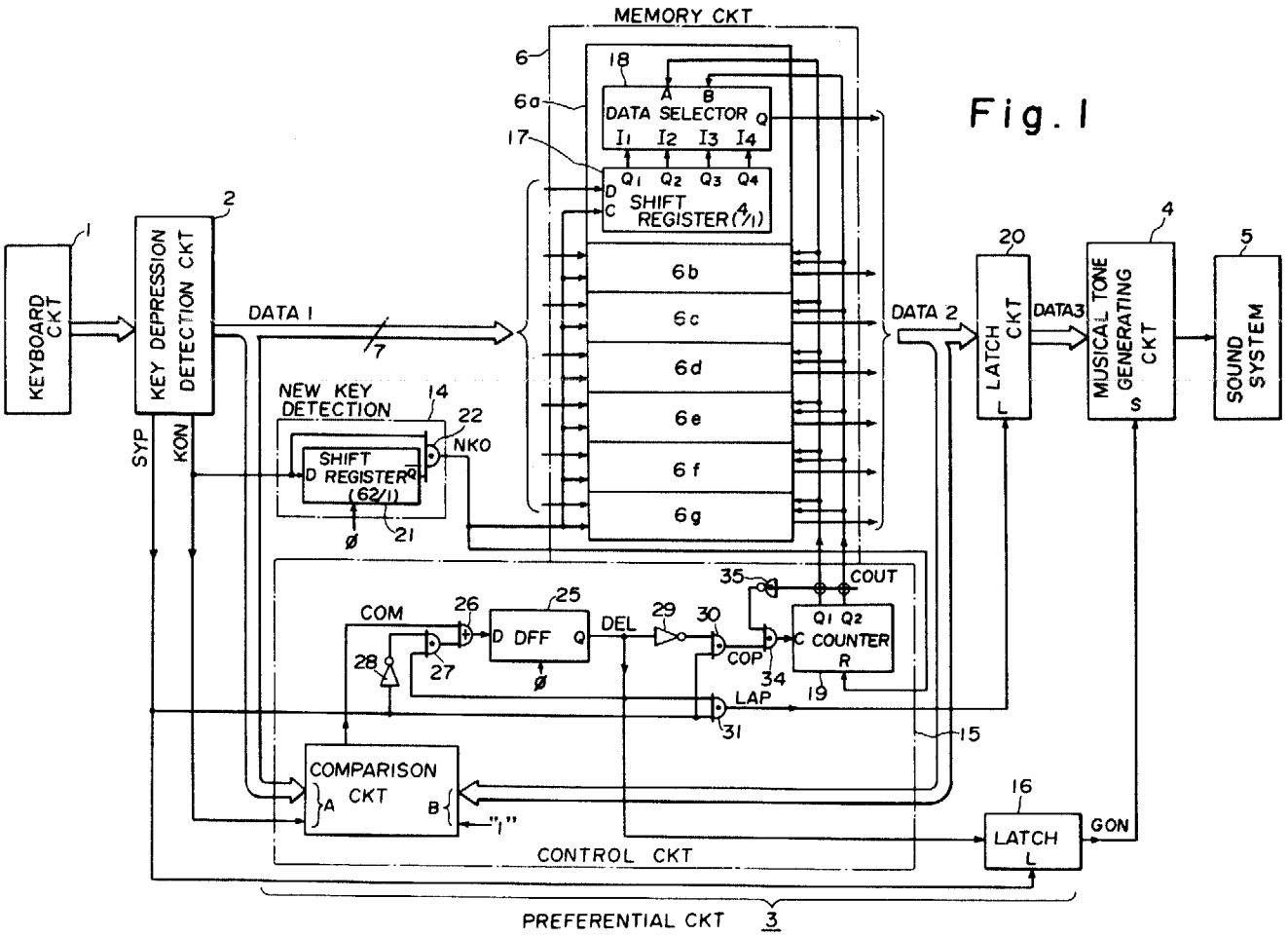
FIG. 1 is a block diagram showing a preferred embodiment of a preferential circuit according to the present invention incorporated in an electronic musical instrument.

Referring to FIG. 1, there is shown a block diagram of an example of a preferential circuit adopted for use in an electronic musical instrument such as, for example, an electronic organ. The electronic organ as shown in FIG. 1 is generally comprised of a keyboard circuit 1, a key depression detection circuit 2, a preferential circuit 3, a musical tone generating circuit 4, and a sound system 5. In the electronic organ thus constructed, a musical tone is produced in the following sequence. First, when a key of the keyboard circuit 1 is depressed, the key detection circuit 2 detects the depressed key so as to deliver to the preferential circuit 3 a key data signal corresponding to the depressed key. The preferential circuit 3 memorizes in a sequential order the key data signals delivered from the key detection circuit 2 in a memory circuit 6, and thereafter reads out the most newly depressed key data signal i.e., the key data signal corresponding to the last depressed key from among those stored in the memory circuit 6 in order to deliver it to the musical tone generating circuit 4 through a latch circuit 20. In addition to the above, the preferential circuit 3, when the last depressed key is released, further functions to read out a key data signal corresponding to the most lately depressed key among the remaining keys which are kept depressed or in other words the second last depressed key counted from the last one, in order to likewise deliver it to the musical tone generating circuit 4. The musical tone generating circuit 4 in turn generates a musical tone signal (among signal) in accordance with the key data signal delivered from the preferential circuit 3. Finally, the sound system 5 produces a musical note in accordance with the musical tone signal supplied from the musical tone generating circuit 4.

A more detailed description in connection with each portion of circuits depicted in FIG. 1 will be given hereinunder, wherein signals denotes as "1" or "0" respectively represent a signal having a logical value of "1" or "0."

The keyboard circuit 1 is comprised of a plurarity of keys, and key switches which corresponds to respective keys. In this example of the present invention, there is provided sixty-one keys covering five octaves plus one note and sixty-one key switches to deliver a signal indicative of a release and depression condition of each key to the key detection circuit 2.

Figure 2:
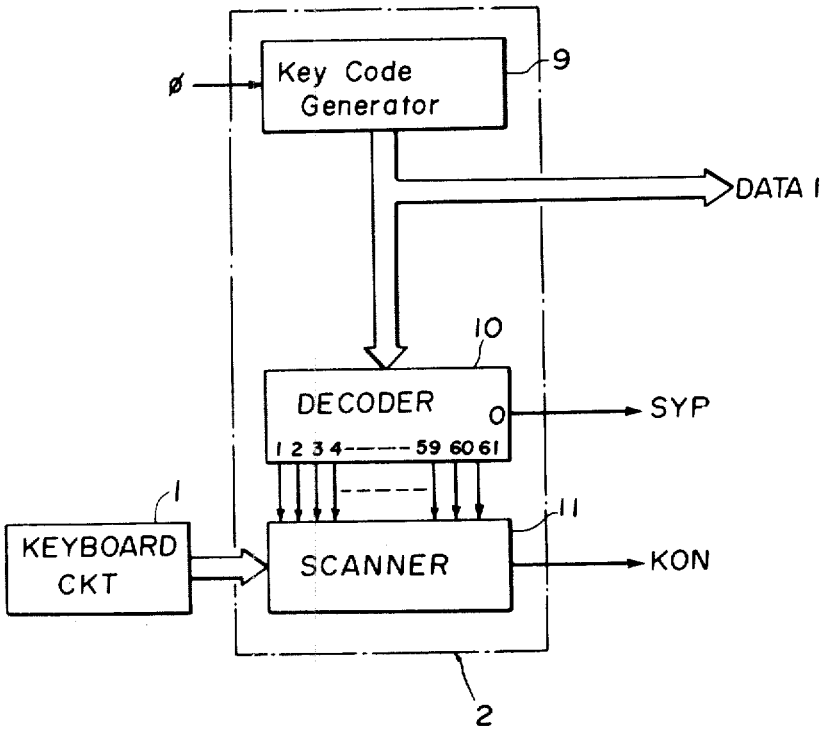
FIG. 2 is a block diagram showing a detailed arrangement of a key detection circuit shown in FIG. 1.

The key detection circuit 2 as shown in FIG. 2 is comprised of a key code generator 9, a decorder 10, and a scanning circuit 11. The key data generator 9 comprises a 4-bit counter for note designation and a 3-bit counter for octave designation serially connected to the 4-bit counter, both counters cooperating to generate 7-bit key data signals of 62 kinds corresponding to the 61 keys and the completion of one repetitive operation of the generator 9. This technique is generally known in this field of the industry and, therefore, detailed description is omitted. The key code generator 9 is clocked to step by a system clock pulse $\phi$ so that this generator sequentially and cyclically produces the 62 key data signals every 62 clock pulses. The output of the generator 9 are supplied both to the decoder 10 and to the memory circuit 6 as key data signal DATA 1. The outputs of the key data generator 9 are distinguished as (0) to (61) wherein the output (0) corresponds to the completion of one repetitive operation of the generator 9. The output (1) corresponds to the key data signal assigned to the lowest pitch, the output (2) corresponds to the key data assigned to the next lowest pitch, - - - , and the output (61) corresponds to the key data assigned to the highest pitch. The system clock pulse $\phi$ has $1\mu$ sec pulse duration and serves as a fundamental clock pulse for sequential control of the electronic organ.

The decoder 10 decodes the output of the key code generator 9, and has so many output terminals as respectively deliver a corresponding decoded output (0) to (61) of the generator 9. The output signal from the (0) output terminal of the decoder 10 is delivered to the preferential circuit 3 and utilized as a synchronous pulse, SYP, and the output signal from each of the respective (1) to (61) output terminal is delivered to the scanning circuit 11 wherein the outputs of the key switches of the key switch circuit 1 and hence the making and breaking state of the key switches is detected by scanning repeatedly and cyclically in accordance with the output of the decorder 10. Then, the output of the scanning circuit 11 which is designated as a key-on signal KON is delivered to the preferential circuit 3. The key-on signal KON is "0" during all of the keys of the keyboard circuit 1 are not under operation, while, after any one of the keys is depressed, the signal KON turns to be "1" at the time instant when the output of the generator 9 coincides with the key data signal assigned to the key concerned, and the signal KON remains "0" when the output of the generator 9 does not coincide with the key data of the key concerned. Supposing that a key, for example, the fifth key from the lowest pitch is depressed, the signal KON will be "0" during the output of the generator 9 is (0) to (4), the signal KON turns to be "1" only when the output of the generator 9 becomes (5), and the signal KON will again change to "0" when the output of the generator 9 becomes (6), (7) and so on. Similarly, if the fifth and seventh keys are depressed, the signal KON will be "1" only when the output of the generator 9 becomes either (5) or (7). It can, therefore, be readily inferred which key or keys are depressed among other keys by simply detecting at what timing the key-on signal KON is "1" or "0."

Next, given is a detailed description for the preferential circuit 3 which is composed of the memory circuit 6, a new key detection circuit 14, a control circuit 15, a latch 16, and a latch circuit 20.

The memory circuit 6 is composed of seven key data memories *6a* to *6g* having the same configuration with each other and each memory acting to memorize each bit of the key data DATA 1 corresponding to depressed keys in the same sequential order as that of depressed keys. Each key data memory *6a* to *6g* is made of a shift register 17 and a data selector 18, as shown in a key data memory *6a*. The shift register 17 is of a 4 stage/1 bit type, and a new key signal NKO outputted from the new key detection circuit 14 is supplied to the register 17 at a clock terminal C thereof, one bit portion of the key data signal DATA 1 composed of 7 bits being supplied to the register 17 at an input terminal D thereof, and output terminals Q1 to Q4 of the register 17 being connected to input terminals $I_1$ to $I_4$ of the data selector 18, respectively. Since the new key signal NKO changes, as will be described hereinafter, to "1" every time a key of the keyboards is newly depressed, the shift register 17 stores therein the key data signal DATA 1 in response to the new key signal NKO "1," so that the resultant key data signal to be outputted from the output terminal Q1 to Q4 may be arranged in the same sequential order as that of key depressions, i.e., the data signal to be obtained at the terminal Q1 corresponds to the newest key depressed, and the data signal at the terminal Q2 corresponds to the key depressed just prior to the newest key, or in other words the second newest key depressed and the data at the terminals Q3 and Q4 follow in the same manner as above, that is, they correspond to the third and fourth newest keys depressed.

The data selector 18 then selectively transfers one of the data signals supplied at the input terminals $I_1$ to $I_4$ to an output terminal Q in response to a signal composed of a combination of binary coded signals inputted at terminals A and B, the relation between this binary signals and the data signal to be transfered to the output terminal Q being tabulated in Table 1.

TABLE 1

| A | B | Q |
|---|---|---|
| 0 | 0 | $I_1$ |
| 1 | 0 | $I_2$ |
| 0 | 1 | $I_3$ |
| 1 | 1 | $I_4$ |

To the terminals A and B, the output (Q1, Q2) of a counter 19 in the control circuit 15 is supplied, and the transfered data signal at the output terminal Q is fed as key data signal DATA 2 to the latch circuit 20.

The new key detection circuit 14 is implemented in order to detect a newly depressed key, which functions to deliver a new key signal NKO at the time instant when the key data signal corresponding to the newly depressed key is outputted from the key detection circuit 2, and is composed of a 62 stage/1 bit type shift register 21 to a clock terminal of which the prescribed system clock pulse $\phi$ is being supplied, and an AND gate 22. In operation, when a key corresponding to, for example, the fifth lowest tone is newly depressed, the key-on signal KON turns to "1" at the time instant when the output of the counter 9 (see FIG. 2) becomes (5), and hence this "1" signal is fed to both an input terminal of the shift register 21 and one of the input terminals of the AND gate 22. It is to be noted here that at this time instant the output of the shift register 21 at a Q output terminal has already been changed to "1." This is because the key corresponding to the fifth lowest tone has not yet been depressed at the time instant when the output of the counter 9 at its preceding count cycle changed to (5) and the output key-on signal KON then fed to the shift register 21 is "0." This "0" signal has been shifted after 62 bits time lapse of the system clock pulse $\phi$ to output "1" signal at the Q output terminal. Thus, the "1" signal supplied to the one of the input terminals of the AND gate 22 is passed therethrough to output a new key signal NKO "1" at the same time the key-on signal "1" generated in response to the new depression is stored at the first stage of the shift register 21 in synchronization with the system clock pulse $\phi$. Following the above circuit operation, if the key corresponding to the fifth lowest pitch is still held depressed at the time instant when the output of the counter 9 becomes (5) at its next count cycle, i.e., after the time lapse of another 62 bits time a key-on signal KON "1" is again delivered from the key detection circuit 2 to supply it to the one of the input terminals of the AND gate 22. In this case, however, a new key signal NKO is not delivered from the AND gate 22, because "0" signal is supplied to the other input terminal of the AND gate 22 from the output terminal Q of the shift register 21 due to the fact that "1" signal has already been stored in the first stage of the shift register 21 at the time of generating the output (5) from the counter 9 at its preceding count cycle. Thus, it is to be understood that the new key detection circuit 14 may deliver a new key signal NKO, i.e., "1" signal only at a single time instant when a key data signal Data 1 corresponding to the newly depressed key is outputted from the key depression detection circuit 2.

The control circuit 15 is aimed at controlling reading-out of the data signal from the memory circuit 6, storing-in of the data signal to the latch circuit 20, generating a musical tone signal from the musical tone generating circuit 4, and etc. As shown in FIG. 2, the circuit 15 is comprised of a comparison circuit 24, a delayed flip-flop 25 (hereinafter designated as DFF for abridgement), a counter 19, and a plurality of gate circuits.

Figure 3:
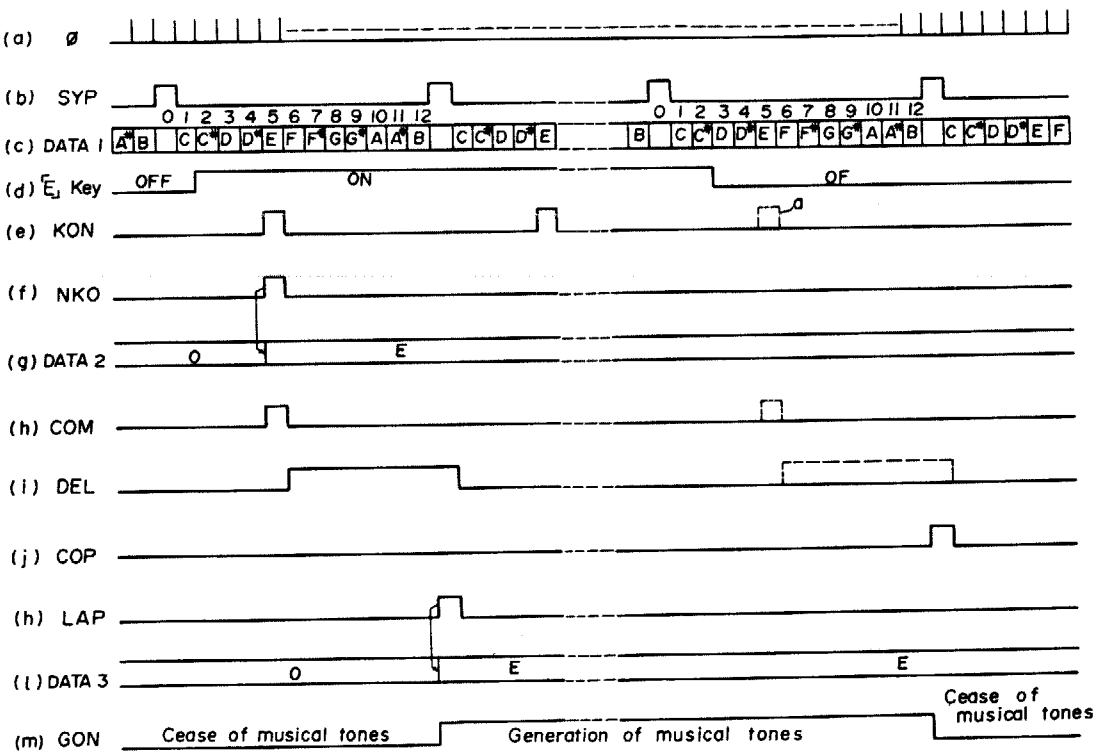
FIGS. 3 and 4 are timing charts for illustrating the operation of the circuit shown in FIG. 1.
Figure 4:
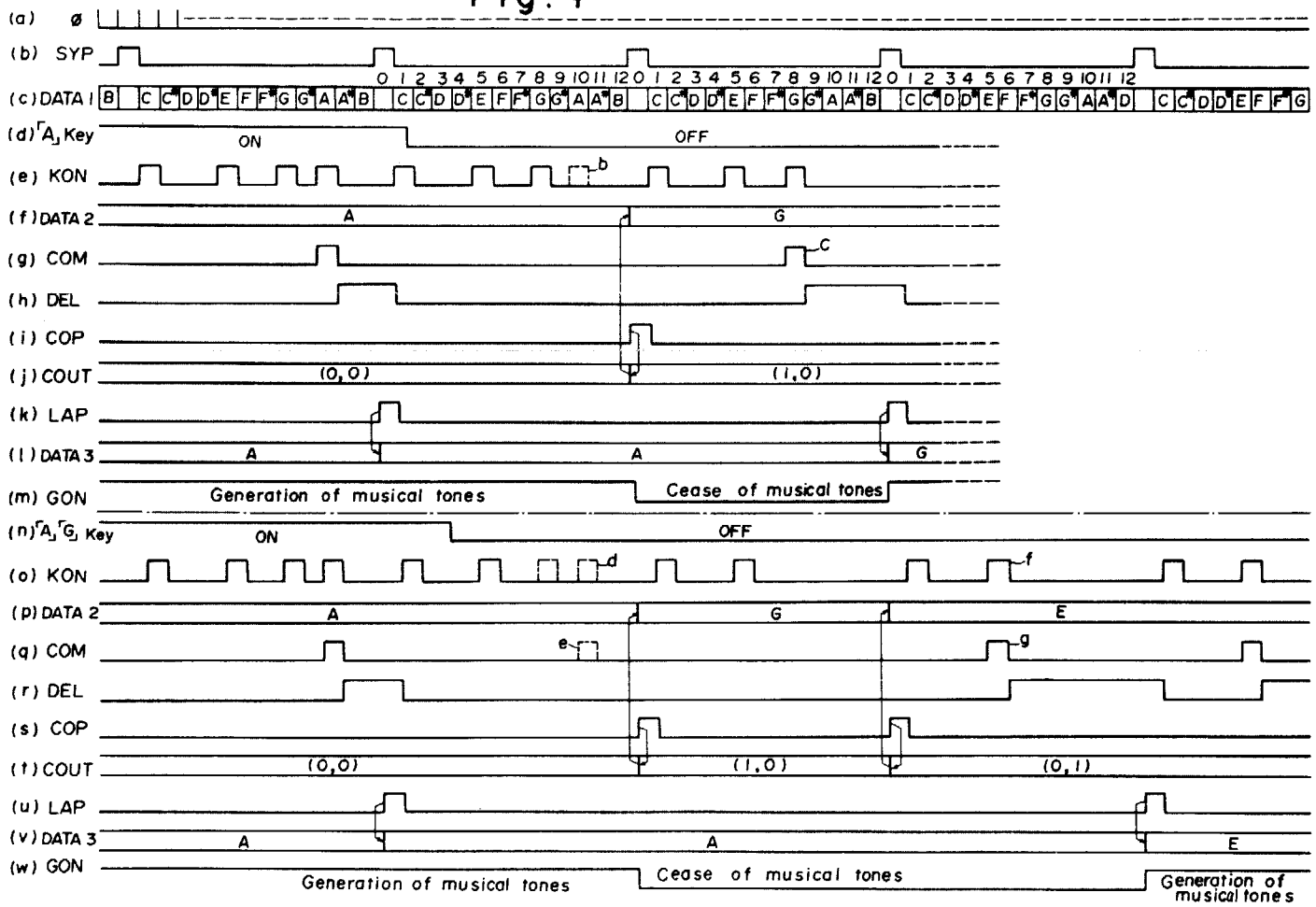

Referring now to the timing charts shown in FIGS. 3 and 4, the operation of the electronic organ thus constructed, and particularly of the control circuit 15 will be described, where the number of keys of the keyboard circuit 1 is limited to twelve, i.e., corresponding to an octave, in order to clarify the description, and the keys are designated from the lowest tone in order as C, C#, D, D#, E, F, F#, G, G#, A, A#, and B, respectively.

(I) Operation when a single key is depressed

If a key such as for example E key is depressed under the condition that no other keys are operated (see FIG. 3 *d*), a key-on signal KON "1" is then outputted, at the time instant when the output of the counter 9 becomes (5), from the key depression detection circuit 2 to supply it to both the new key detection circuit 14 and the comparison circuit 14. The KON "1" signal supplied to the new key detection circuit 14 causes the circuit 14 to produce a new key signal NKO "1" (see FIG. 3*f*) which is in turn supplied to the memory circuit 6 and further to a reset terminal R of the counter 19, so that the output (5) of the counter 9 is stored as key data signal DATA 1 in the shift registers 17 of the memory circuit 6, and also at the same time instant the counter 19 is reset. More in precise, the key data signal DATA 1 which is at present the output (5) of the counter 9 is stored in the shift registers 17 at the time instant when the key-on signal KON having a rectangular pulse waveshape rises (coinciding with the rising of the new key signal NKO) with a result that the output (5) is transferred to the output terminal Q of the shift registers 17. Moreover, at the same time instant above, the counter 19 is reset in synchronization with the rising of the NKO signal "1" to render the output thereof to be "0, 0" with a result that the output of the memory circuit 6 (which is shown as key data signal DATA 2 as in FIG. 3*g*) is subjected to supply its contents (5) to input terminals B of the comparison circuit 24. In addition to the key data signal DATA 2, "1" signal is always being supplied, as depicted in FIG. 1, to one of the terminals B which corresponds to one of the terminals A where the key-on signal KON "1" is to be supplied. Thus, both of the input signals, i.e., the signal KON plus DATA 1 at the input terminals A, and the signal "1" plus DATA 2 at the input terminals B are compared to deliver a coincidence signal COM "1" when there is a coincidence and a coincidence signal COM "0" when there is no coincidence (see FIG. 3*h*). Since the key-on signal KON has two alternatives "1" or "0," the coincidence signal COM may be "1" only when the KON signal maintains "1." The COM "1" signal indicative of coincidence is transfered through an OR gate 26 to an input terminal of the DFF 25 wherein the system clock pulse $\phi$ is inputted to a clock terminal. The COM "1" signal is then stored in the DFF 25 in response to the subsequent system clock pulse $\phi$ with a result that an output signal "1" appears at the output terminal of the DFF 25 (see FIG. 3*i*). The output of the DFF 25 which is designated as DEL signal "1" is subsequently provided to one input terminal of an AND gate 30 through an inverter 29, to respective one input terminal of AND gates 27 and 31, and to an input terminal of a latch 16. The DEL signal will maintain "1" until a next synchronous pulse SYP is supplied to an input terminal of the inverter 28, because by the time the SYP pulse is supplied continuous provision of "1" signal to the input of the DFF 25 exists. The operation of the circuits described in the above is summarized as follows: assuming that E key is depressed when no other keys are under operation, a key data signal DATA 1, that is (5) corresponding to E key is stored in the memory circuit 6 at the time instant when the key detection circuit 2 detects depression of E key, and at the same time instant the key data signal is read out from the memory circuit 6 so as to be delivered as a key data signal DATA 2 to an input terminal of the latch circuit 20. Following the above operation, the output signal DEL of the DFF 25 turns to be "1," which is provided to respective one input terminals of the AND gates 27 and 31, to an input terminal of the latch 16, and to one input terminal of the AND gate 30 through the inverter 29.

Next, described is the operation of the related circuits which are subjected to receive the next synchronous pulse SYP from the key detection circuit 2 (see FIG. 3*b*) such that the pulse SYP is respectively supplied to the input terminal of the inverter 28, to the other input terminals of the AND gates 30 and 31, and to the load terminal of the latch 16. First, the provision of the SYP "1" signal to the input terminal of the inverter 28 causes to output "0" signal at the output terminal thereof which in turn is supplied to the other input terminal of the AND gate 27, so that the logical product of the AND gate 27 changes to "0." This "0" signal is delivered to one of the input terminals of the OR gate 26, to the other input terminal of which another "0" signal being delivered (refer to FIG. 3*h*), so that the resultant input to the DFF 25 is changed to "0" from its preceding state "1." Accordingly, the output of the DFF, that is DEL signal, is changed to "0" after a certain time lapse which corresponds to one pulse time duration of the system clock pulse $\phi$ (which means that the DFF 25 is reset). The synchronous pulse SYP "1" supplied to the input terminal of the AND gate 30, however, has no effect upon the output of the AND gate 30 due to existence of "0" signal at the other input terminal of the AND gate 30, while the synchronous pulse SYP "1" supplied to the input terminal of the AND gate 31 passes through the AND gate 31 to be supplied as a latch pulse LAP (see FIG. 3*k*) to a load terminal of the latch circuit 20 due to existence of DEL signal "1" at the other input terminal of the AND gate 31. As a result, the latch circuit 20 holds in registry the key data signal DATA 2 appeared at its input terminal which corresponds to a key data signal of E key, thereby delivering it as a key data signal DATA 3 (refer to FIG. 3*l*) to the musical tone generating circuit 4. The synchronous pulse SYP "1" supplied to a load terminal of the latch 16 causes a DEL signal "1" appeared at its input terminal to be transferred to the output terminal thereof so as to deliver "1" signal (see FIG. 3*m*). This "1" signal, i.e., GON signal is then supplied to a start terminal of the musical tone generating circuit 4 to initiate a start of musical tone signal generation in accordance with the key data signal DATA 3 (in the present case this signal is one corresponding to E key). It will be readily understood that the above operation of the control circuit 15 will be repeated during depression of E key.

(II) Operation after release of a key which have previously been depressed.

In the case of releasing a key such as for example E key which has previously been depressed, a key-on signal KON will not be "1" even when the output of the generator 9 becomes (5): this is shown in FIG. 3*e* in a dotted line identified by a reference character a. The respective data signals appeared at the input terminals A and B of the comparison circuit 24 do not coincide with each other due to existence of "0" KON signal so that the coincidence signal COM does not assume "1" (refer to FIG. 3*h*), and hence the output signal DEL of the DFF 25 does not change to "1" signal as well (refer to FIG. 3*i*). As a result, the latch 16 holds in registry "0" signal at the time of generation of a synchronous signal SYP "1" from the key detection circuit 2 so as to deliver an output signal GON "0" from the latch 16 to the musical tone generating circuit 4, thereby ceasing generation of musical tone signals. At the same time as above the output of the counter 19 is forced to be changed to "1, 0" due to the output signal "1" from the inverter 29 which is subsequently transfered to the counter 19 through the AND gates 30 and 34 with the help of another input signal SYP "1" to the AND gate 30. This output "1, 0" of the counter 19 does not adversely effect upon musical tones because the musical tone signals from the musical tone generating circuit 4 are ceased.

(III) Operation when a key is depressed under existence of another already depressed key The situation will be considered hereinbelow in which, for example G key (the contents of the key data signal of which correspond to (8)) is depressed in addition to an already depressed E key. First, it is assumed that G key is depressed while the musical tone signal corresponding to E key is being generated from the musical tone generating circuit 4 under depression of E key. Then, the depression of G key is detected by the new key detection circuit 14 at the time instant when the output of the generator 9 becomes (8) thereby to deliver a new key signal NKO "1" to the memory circuit 6 and counter 19. The shift registers 17 of the memory circuit 6 in turn stores a key data signal (8) corresponding to G key so that the key data signal appears at the output terminal Q1 of the shift registers 17, while the key data signal corresponding to E key appears at the output terminal Q2. The new key signal NKO "1" described above causes the counter 19 to be reset to output "0, 0" with a result that the key data signal corresponding to G key and appearing at the output terminal Q1 of the shift register 17 is supplied as a key data signal DATA 2 to the input terminal of the latch circuit 20. Apart from the above description, a synchronous pulse SYP "1" outputted succeedingly from the key detection circuit 2 functions to generate a latch pulse LAP "1" from the AND gate 31 in cooperation with a DEL signal which has aleady been changed to "1" due to the existence of "0" signal at the input terminal D at the time of detection of G key. Thus, the key data DATA 2 corresponding to G key is held in the latch circuit 20 so as to supply it as DATA 3 to the musical tone generating circuit 4. Accordingly, the musical tone generating circuit 4 generates a musical tone signal corresponding to G key in response to delivery of an output signal GON "1" of the latch 16, resulting in production of a musical tone corresponding to G key at the sound system 5.

The above described operation of the electronic musical organ, particularly its preferential circuit according to the present invention shows the last depression preferential system in which the musical tone corresponding to a newly depressed key is produced under existence of another key which has already been depressed. Hereinbelow the particular cases which substantiate the present invention over the prior art will be described, with reference to FIG. 4.

(IV) Operation after release of the last depressed key, remaining the other keys held depressed as they are Assuming that C, E, G and A keys are maintained depressed which have previously been depressed in this order, there appear key data signals each corresponding to A, G, E and C at the respective output terminals Q1 to Q4 of the shift register 17 of the memory circuit 6. At this stage of operation the key data signal DATA 2 is selectively chosen to that corresponding to A key due to the count output COUNT "0, 0" delivered at the data selectors from the counter 19, so that the coincidence signal COM "1" is outputted from the comparison circuit 24 at the time of generation of a key-on signal KON corresponding to A key (see FIG. 4*g*), and accordingly the signal DEL changes to "1" at the falling time of the coincidence signal COM. Thus, the musical tone corresponding to the last depressed A key is kept generating at the sound system 5 by receiving the corresponding musical tone signal from the musical tone generating circuit 4.

Next, if A key is released (see FIG. 4*d*), a key-on signal KON "1" is not delivered at the time instant when the key code generator 9 outputs (10) (which is designated by a reference character b in FIG. 4*e*), so that both the coincidence signal COM of the comparison circuit 24, and the output signal DEL of the DFF 25 don't turn to be "1." As a result, when a subsequent synchronous pulse SYP "1" is outputted from the key detection circuit 2, this pulse SYP is passed through the AND gate 30 to be used as a signal COP (see FIG. 4*i*) at one of the input terminals of the AND gate 34. At the other input terminal of the AND gate 34 there is supplied "1" signal from the NAND gate 35 to which the count output "0, 0" of the counter 19 is inputted. As a result, the logical product of the signal COP "1" and the output signal "1" from the NAND gate 35 turns to be "1" signal at the clock terminal of the counter 19, resulting in change of the count output to "1, 0" (see FIG. 4*j*). The count output "1, 0" makes the data selector 18 of the memory circuit 6 and the other data selectors as well to select the data signal supplied to their terminals $I_2$ from the respective output terminals Q2 of the shift registers 17. This data signal corresponds G key and is supplied as a key data DATA 2 to the input terminal of the latch circuit 20 (see FIG. 4*f*). At the same time instant as above when the synchronous pulse SYP "1" is supplied to the load terminal of the latch 16, the DEL signal "0" held at the latch 16 is transferred to the output terminal thereof so as to be delivered to the musical tone generating circuit 4 the signal GON "0" for stopping generation of musical tone signals (see FIG. 4*m*). It is to be noted that the synchronous pulse SYP has no effect upon the output of the AND gates 27 and 31 because the DEL signal "0" is supplied to the respective AND gates 27 and 31 regardless of the existence of the synchronous pulse SYP appeared at the AND gate 27 through the inverter 28, and AND gate 31.

Thereafter when the key code generator 9 is shifted to output (8) (which corresponds to a key data signal DATA of G key), coincidence is performed between the data signals appearing at the input terminals A and B of the comparison circuit 24, resulting in delivery of a coincidence signal COM "1" therefrom (refer to a pulse identified by a reference character C depicted in FIG. 4*g*). This coincidence signal COM "1" causes at its falling the DEL signal to change to "1," and this signal "1" is used for making in cooperation with the subsequent synchronous pulse SYP the AND gate 31 to output LAP signal "1" (see FIG. 4*k*). The LAP signal "1" then initiates the latch circuit 20 to transfer to the musical tone generating circuit 4 a key data signal DATA 2 as a key data signal DATA 3 corresponding to G key (see FIG. 4*l*). The musical tone generating circuit 4 therefore generates a musical tone signal corresponding to G key in response to the output signal GON "1" of the latch circuit 16 (see FIG. 4*m*), and the DFF 25 is reset by the synchronous pulse SYP at its falling, thereby to continue generation of a musical tone corresponding to G key at the sound system 5 until a new key operation is effected.

As is readily seen from the above description, the electronic organ which adopts the preferential circuit according to the invention may advantageously be made in such a manner that a musical tone is produced corresponding to the second last depressed key when the last depressed key, i.e., the most newly depressed key is released. Similarly in principle, when the second last depressed key is released, a musical tone is produced which corresponds to the third last depressed key. In this example since the memory circuit 6 is constructed by 4 stage/1 bit shift registers, it is possible at the most to produce in a similar manner musical tone signals which correspond to from the first last depressed key to the fourth last depressed key. It should be noted, however, that the number of the musical tone signals to be produced in like manners will be arbitrarily varied with the number of stages of the shift register.

(V) Operation after simultaneous release of both the last depressed key and the second last depressed key, where there still remains a key or keys depressed It is assumed that the initial condition of the key operation is similar to the prescribed operation (IV), wherein C, E, G and A keys are maintained depressed which have previously been depressed in this sequential order. When G and A keys are released simultaneous (see FIG. 4*n*), a key-on signal KON "1" to be outputted in response to depression of A key is not generated (see a pulse identified by a reference character d in FIG. 4*o*) with a result that both the signal COM (see a pulse identified by a reference character e in FIG. 4*q*) and signal DEL do not change to be "1". The signal COP, however, changes to "1" at the time of delivery of a following synchronous pulse SYP "1" so that the count output COUNT of the counter 19 turns to be "1, 0" (see FIG. 4*t*), resulting in transference of key data, which corresponds to G key and appears at the output terminal Q2 of the shift register 17, to an input terminal of the latch circuit 20 (see FIG. 4*p*). At the same instant, the output signal GON of the latch 16 turns to be "0" (see FIG. 4*w*) so that musical tone signals stop being generated.

Next, key data signals DATA 1 corresponding to respective C to B keys are outputted from the key detection circuit 2 sequentially. During this time period key data DATA 2 corresponding to G key is being supplied to the input terminals B of the comparison circuit 24, while to the input terminals A the same data signal as key data DATA 2 corresponding to G key is supplied as DATA 1 under the condition that the key on signal KON is "0" at this time instant (this is because G key has already been released). Accordingly, both the coincidence signal COM and signal DEL don't change to "1." Thus, at the time of delivery of the following synchronous pulse SYP "1," the signal COP changes to "1" as is similar in the preceding cycle and hence the count output of the counter 19 changes likewise at this time to "0, 1." This results in that a key data signal which corresponds to E key and appears at the output terminals Q3 of the shift registers in the memory circuit 6 is transferred as a key data signal DATA 2 to the input terminal of the latch circuit 20 (see FIG. 4*p*). The latch 16 transfers the signal DEL "0" to maintain the output GON signal to be "0" (see FIG. 4*w*).

Thereafter when the generator 9 is shifted to output 5 (which corresponds to a key data signal of E key), a key-on signal KON "1" is outputted under existence of E key depression (refer to a pulse identifier by a reference character f in FIG. 4*o*). Since the key data signal DATA 2 corresponding to E key is supplied to the input terminals B of the comparison circuit 24, the coincidence of the key data signal with that supplied to the input terminals A is performed thereby to output a coincidence signal COM "1" (refer to a pulse identified by a reference character g in FIG. 4*q*). At the falling time instant of the signal COM, the signal DEL changes to "1" (see FIG. 4*r*) so that, when the following synchronous pulse SYP "1" is outputted, a latch pulse LAP "1" is delivered from the AND gate 31 (see FIG. 4*u*) to transfer the key data signal DATA 2 corresponding to E key into the latch circuit 20 (see FIG. 4*v*). The latch 16 operates by provision of the above SYP "1" to output a GON signal "1" (see FIG. 4*w*) with a result that the musical tone generating circuit 4 generates a musical tone signal corresponding to E key. The DFF 25 is then reset (that is, the signal DEL changes to "0") at the falling time instant of the synchronous pulse SYP in cooperation with a signal "0" supplied at the input terminal of DFF 25.

As described above it is to be noted that the electronic organ which adopts the preferential circuit according to the invention may advantageously be constructed in such a manner that when both the last depressed key and the second last depressed key are released simultaneously, the musical tone signal corresponding to the third last depressed key is generated at the musical tone generating circuit 4 so as to produce in the sound system 5 the musical tone in accordance with the musical tone signal.

From the foregoing detailed description, it should be appreciated that, since the preferential circuit according to the present invention is made such that an intended musical tone as desired to be produced is chosen selectively from key data signals stored in a memory circuit provided in the preferential circuit wherein the key data signals corresponding to depressed keys have previously been stored in a predetermined order, it is possible, for example, to produce a correct musical tone by simply releasing an erroneously depressed key which have been depressed following the depression of a correct one. This enables a player for electronic musical instruments to carry out his practice efficiently. While there have been shown and described a preferred embodiment of the present invention, it is to be understood that the present invention is not limited thereto but may be variously modified and practiced within the scope set forth in the attached claims.

What is claimed is:

1. In a monophonic electronic musical instrument comprised of a keyboard circuit including a plurality of keys, a key depression detection means for detecting a depressed key or keys to produce key data signals assigned to the depressed keys, a musical tone generating circuit for producing a musical tone signal in correspondence with a key selected among the keys held depressed according to a most recently depressed key taking preferential order, and a preferential circuit for supplying a key data signal to the musical tone generating circuit based on said preferential order, said preferential circuit comprising:

(a) new key detection means which detects whether a depressed key is newly depressed or it has been previously depressed to produce a new key signal when the key is newly depressed, irrespectively of the relative positions on the keyboard of said newly depressed key and said previously depressed key;

(b) memory means for storing the key data signal corresponding to said newly depressed key and at least one key data signal corresponding to a key depressed just prior to said newly depressed key, respectively received from said key depression detection means;

(c) control means operatively coupled to said new key detection means for reading out from said memory means the key data signal corresponding to said newly depressed key when said newly depressed key and the key depressed prior to said newly depressed key are held depressed and for reading out from the memory means the key data signal corresponding to said key depressed just prior to said newly depressed key when said newly depressed key is released with said key depressed just priot to said newly depressed key being held depressed, said musical tone generating circuit being responsive to the key data signal read out of memory means thereby to produce the musical tone signal.

2. A preferential circuit according to claim 1, wherein said memory means is comprised of a shift register circuit which is responsive to said new key signal to store therein the key data signals of the depressed keys in a sequential order according to the order of the key depressions.

3. A preferential circuit according to claim 1, wherein said control means is comprised of a comparison circuit for comparing the key data signals from said memory means and said key depression means to detect a release of the key corresponding to the key data signal read from the memory means, and said preferential circuit further comprises signal supplying means for controlling the supply of the key data signal from the memory means to the tone generating circuit according to an output of said comparison circuit.

4. A preferential circuit according to claim 1 or 2, wherein said control circuit is further comprised of a counter responsive to said new key signal to cause said memory means to output said key data signal corresponding to said key depressed just prior to said newly depressed key when said newly depressed key is released.

5. A preferential circuit according to claim 1, wherein said key depression detection means produces a key depression signal representing a depressed state of a key, and said new key detection means comprises holding means for holding said key depression signal and a logical circuit receiving the key depression signal from said key depression detection means and an output of said holding means to produce said new key signal.

6. A monophonic electronic musical instrument comprising:

keyboard means including a plurality of keys;

key depression detection means for detecting a depressed key or keys to produce key data signals corresponding to the depressed keys;

preferential circuit means responsive to said key depression detection means for delivering out a signal key data signal selected from said key data signals based on a most recently depressed key taking preferential order, said preferential circuit means comprising new key detection means to detect whether a depressed key is newly depressed or it has been previously depressed to produce a new key signal when the key is newly depressed, irrespectively of the relative positions on the keyboard of said newly depressed key and said previously depressed key; memory means responsive to said new key signal for storing therein the key data signal of the depressed keys in the timewise order of the key depressions, and readout means for reading out from said memory means the key data signal corresponding to the most recently depressed key which is still being depressed, the read out key data signal being delivered out from said preferential circuit means; and musical tone generating means responsive to the key data signal from said preferential circuit means to produce a musical tone signal.

* * * * *